US012551007B2

(12) United States Patent
Bagby et al.

(10) Patent No.: US 12,551,007 B2
(45) Date of Patent: Feb. 17, 2026

(54) COLLAPSIBLE TABLE

(71) Applicant: Crazy Creek Products LLC, Red Lodge, MT (US)

(72) Inventors: Karson Bagby, Red Lodge, MT (US); Forrest Rogers, Red Lodge, MO (US)

( * ) Notice: Subject to any disclaimer, the term of this patent is extended or adjusted under 35 U.S.C. 154(b) by 134 days.

(21) Appl. No.: 18/660,620

(22) Filed: May 10, 2024

(65) Prior Publication Data

US 2025/0344843 A1 Nov. 13, 2025

(51) Int. Cl.

*A47B 3/00* (2006.01)
*A47B 3/08* (2006.01)
*A47B 3/083* (2006.01)

(52) U.S. Cl.

CPC ..... *A47B 3/083* (2013.01); *A47B 3/0815* (2013.01); *A47B 2003/008* (2013.01); *A47B 2003/0824* (2013.01); *A47B 2200/0036* (2013.01); *A47B 2200/0052* (2013.01); *A47B 2200/0064* (2013.01)

(58) Field of Classification Search

CPC . A47B 3/083; A47B 3/0815; A47B 2003/008; A47B 2003/0824; A47B 2003/0821; A47B 2200/0036; A47B 2200/0052; A47B 2200/0064; A47B 3/00

USPC ..... 108/67, 99, 162, 166, 167–172, 115, 108/33–35, 38, 13, 127, 133, 147.19, 108/147.2, 147.21, 64, 65; 190/12 R; 248/188.5–188.8

See application file for complete search history.

(56) References Cited

U.S. PATENT DOCUMENTS 2,101,573 A * 12/1937 Cramer ..... A47B 3/12 108/129
2,204,081 A * 6/1940 Harrell ..... A47B 3/0815 108/129
2,311,798 A * 2/1943 Weber ..... A47B 3/10 108/35
2,432,266 A * 12/1947 Wilkinson ..... A47B 3/0815 125/11.11
2,451,763 A 10/1948 Misko
2,487,401 A * 11/1949 Turner ..... A47B 3/0815 403/92

(Continued)

FOREIGN PATENT DOCUMENTS

CN 204048598 U 12/2014
CN 205493000 U 8/2016

(Continued)

*Primary Examiner* — Janet M Wilkens
(74) *Attorney, Agent, or Firm* — Antoinette M. Tease

(57) ABSTRACT

A collapsible table with four quarter sections. The first and second sides of each quarter section have a protrusion, a recess that receives the protrusion on an adjacent quarter section, and two apertures that allow a bungee cord to pass through them. The third and fourth sides of each quarter section are flat. The table has four outer and four inner legs, the outer legs being stowable on the underside of the tabletop, and the inner legs being telescopically coupled with the outer legs. The outer and inner legs are constructed so that the overall height of the table can be adjusted depending on how the inner legs are inserted into the outer legs. The table includes a key that fits into the underside of each quarter section to hold the tabletop together and two bungee cords that function as hinges between the quarter sections.

6 Claims, 10 Drawing Sheets

(56) References Cited

U.S. PATENT DOCUMENTS

| | | | | | |
|---|---|---|---|---|---|
| 2,862,777 | A * | 12/1958 | Paige | A47B 3/083 | 108/34 |
| 2,944,678 | A * | 7/1960 | Barfield | A47F 5/105 | 403/220 |
| 4,675,929 | A * | 6/1987 | Santo | A47C 19/025 | 5/915 |
| 5,730,066 | A | 3/1998 | Auten | | |
| 6,132,338 | A * | 10/2000 | Shifferaw | A63B 5/08 | 482/52 |
| 2001/0048059 | A1* | 12/2001 | Jones, II | A47B 97/08 | 248/161 |
| 2010/0186638 | A1 | 7/2010 | Roy et al. | | |
| 2010/0288170 | A1 | 11/2010 | Humphrey | | |
| 2015/0320201 | A1* | 11/2015 | Meadows | A47B 3/08 | 29/428 |

FOREIGN PATENT DOCUMENTS

| | | | | | |
|---|---|---|---|---|---|
| CN | 209315178 | U | | 8/2016 | |
| CN | 206462620 | U | | 9/2017 | |
| CN | 211211879 | U | | 8/2020 | |
| CN | 213096749 | U | | 5/2021 | |
| CN | 213550473 | U | | 6/2021 | |
| CN | 213587682 | U | | 7/2021 | |
| CN | 213882237 | U | | 8/2021 | |
| CN | 214283817 | U | | 9/2021 | |
| CN | 214963311 | U | | 12/2021 | |
| CN | 116763055 | A | | 9/2023 | |
| KR | 200147070 | Y1 | | 6/1999 | |
| KR | 200398598 | Y1 | * | 10/2005 | A47B 3/10 |
| KR | 200460065 | Y1 | | 5/2012 | |
| WO | WO-2020069237 | A1 | * | 4/2020 | A47B 3/083 |
| WO | WO-2020163691 | A1 | * | 8/2020 | E01F 9/688 |

* cited by examiner

COLLAPSIBLE TABLE

BACKGROUND OF THE INVENTION

1. Field of the Invention

The present invention relates generally to the field of outdoor furniture, and more specifically, to a collapsible, portable table for camping and other outdoor or indoor uses.

2. Description of the Related Art

When camping and backpacking, a person often does not have a table available on which to rest food, drinks, stoves, cards and similar items to keep them out of the dirt. This is especially true when using a CRAZY CREEK PRODUCTS® chair, as a person typically would be sitting on the ground. The present invention is a table that folds up compactly, is very light, and allows anyone using a CRAZY CREEK PRODUCTS® or similar chair to have a clean, flat and level place on which to place various items. Although there are other collapsible tables, none possesses the unique structural features of the present invention, as explained more fully below.

U.S. Patent Application Pub. No. 2010/0288170 (Humphrey) discloses a dual-axis folding table with four quarter panels that together form a tabletop when extended. The first and second quarter panels are hinged together with a first axis hinge along a first folding axis, and the third and fourth quarter panels are hinged together with an additional first axis hinge, also along the first folding axis. The second and third quarter panels are further hinged together with a second axis hinge along a second folding axis. The first panel is configured to fold into the second panel about the first axis hinge, and the fourth panel is configured to fold into the third panel about the additional first axis hinge, thereby folding the tabletop in half. The second panel is configured to fold into the third panel about the second axis hinge, thereby folding the tabletop into a quarter-sized self-contained carrying case.

U.S. Patent Application Pub. No. 2010/0186638 (Roy et al.) describes a foldable table in which the legs are configured to extend beyond the footprint of the table in an extended position. In a storage position, the table legs are tucked within the footprint of the table. The legs are configured to slide and pivot within sockets in the four corners of the tabletop. When the leg is disposed upwardly within a slot in the socket, it is prevented from rotating. When the leg is disposed downwardly within the slot, it is able to freely rotate into a storage position.

U.S. Pat. No. 2,451,763 (Misko, 1948) covers a folding table with a sectional top. The top is divided into four sections, with hinge means configured to couple the sections together in pairs to form two portions, one of which is foldable against the other. A hinge bar is slidably supported between two opposed guides. The hinge bar has a long center part and end parts that are hingedly connected to an end of the center part. The invention includes a sliding coupling between opposing longitudinal edges of each end part of the hinge bar. The center part of the hinge bar may be disposed in a position between the two table portions upon separation of one portion from the other. The invention includes means for locking the end parts of the hinge bar to the guides when the two table portions are moved together on the hinge bar and means for establishing a rigid connection between the other two sections of the two table portions when the portions and sections are in a common plane. Telescoping legs are secured with notches and a locking pin.

U.S. Pat. No. 5,730,066 (Auten et al., 1998) provides a portable table that is configured for attachment to an external support such as the trunk latch of a motor vehicle. The portable folding table has an adaptor on one end for attaching one of the two table panels to the trunk latch and a pair of foldable, independently telescopically adjustable legs on the other end. The two table panels include downwardly extending edges around the perimeter of the table that form a space into which the legs may be folded for storage. The invention includes integrally molded handle extension that together form a single handle when the table is in a folded position.

BRIEF SUMMARY OF THE INVENTION

A collapsible table comprising: four quarter sections, each of which has a top surface that is flat and square, an underside that is the same size as the top surface, a first side, a second side, a third side, and a fourth side; wherein the first side of each quarter section comprises a protrusion, a recess that is configured to receive the protrusion on an adjacent quarter section, and two apertures that are configured to allow a bungee cord to pass through them; wherein the second side of each quarter section comprises a protrusion, a recess that is configured to receive the protrusion on an adjacent quarter section, and two apertures that are configured to allow a bungee cord to pass through them; wherein the third side of each quarter section is flat; and wherein the fourth side of each quarter section is flat; a key with four extensions; wherein the underside of each quarter section comprises a hole that is situated in a corner of the underside and configured to receive one of the four extensions on the key; four outer legs; and four inner legs; wherein each of the four outer legs is pivotally connected to a corner of one of the four quarter sections at a pivot point; and wherein each of the four inner legs is slidably coupled to one of the four outer legs so that the inner leg slides within the outer leg.

In a preferred embodiment, the invention further comprises a first bungee cord; wherein the first bungee cord is configured to pass though one aperture in each of a first two of the quarter sections and two apertures in each of a second two of the quarter sections, wherein the apertures through which the first bungee cord passes are situated in a center part of the underside of the table when the table is in a fully extended position. In a preferred embodiment, the invention further comprises a second bungee cord; wherein the underside of each quarter section comprises an outside channel that extends along an outside edge of the third side and the fourth sides of the quarter section; wherein the second bungee cord is situated within the outside channel of and configured to pass through two apertures in a first two of the four quarter sections, the two apertures being situated proximate to an outer edge of the underside of the quarter section; and wherein the second bungee cord is configured to pass through one aperture in a second two of the four quarter sections, the one aperture being situated proximate to the outer edge of the underside of the quarter section.

In a preferred embodiment, the underside of each quarter section comprises a receptacle that is configured to receive all four of the extensions on the key, Preferably, each of the quarter sections comprises a spring that is attached on one end to the corner of the quarter section proximate to the pivot point and on the other end to a center part of the outer leg. Each of the outer legs is preferably configured to fit within a diagonal channel that extends diagonally across the underside of the quarter section to which the outer leg is pivotally attached.

In a preferred embodiment, each outer leg is rectangular in cross-section; wherein each of the outer legs comprises a first inner wall, a second inner wall, a third inner wall, and a fourth inner wall; wherein each of the first inner wall, the second inner wall, the third inner wall, and the fourth inner wall comprises an internal channel that extends longitudinally from a distal end of the outer leg for a certain distance; wherein the distance by which the internal channel in the first inner wall extends from the distal end of the outer leg is less than the distance by which the internal channel in the second inner wall extends from the distal end of the outer leg, the distance by which the internal channel in the second inner wall extends from the distal end of the outer leg is less than the distance by which the internal channel in the third inner wall extends from the distal end of the outer leg, and the distance by which the internal channel in the third inner wall extends from the distal end of the outer leg is less than the distance by which the internal channel in the fourth inner wall extends from the distal end of the outer leg, thereby creating four different internal channels of four different lengths in the inner walls of the outer leg; and wherein the internal channels on a first two opposing inner walls of the outer leg each has a first depth, and the internal channels on a second two opposing inner walls of the outer leg each has a second depth, the first depth being less than the second depth.

In a preferred embodiment, each inner leg is rectangular in cross-section; wherein each of the inner legs comprises a first protuberance on a first side of the inner leg and a second protuberance on a second side of the inner leg, the first and second sides of the inner leg being adjacent and not opposing; wherein each of the first protuberance and the second protuberance has a height, the height of the first protuberance being less than the height of the second protuberance; and wherein the first protuberance is configured to fit within the internal channels on the first two opposing inner walls of the outer leg, and the second protuberance is configured to fit within the internal channels on the second two opposing inner walls of the outer leg.

REFERENCE NUMBERS

Figures 1, 2:
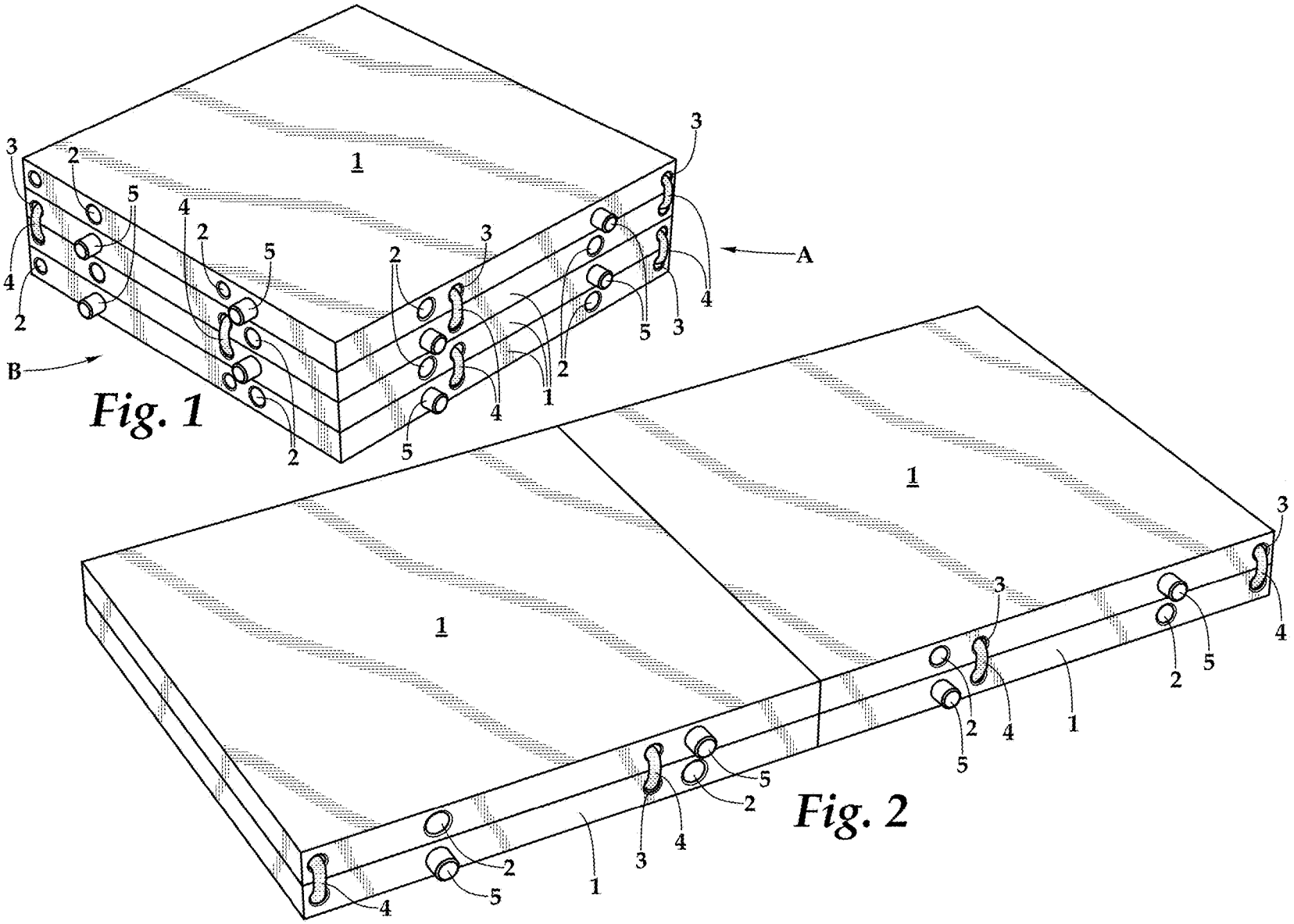
FIG. 1 is a first perspective view of the present invention shown in a fully collapsed position.
FIG. 2 is a first perspective view of the present invention shown in a partially collapsed position with two of the four quarter sections situated on top of the two other quarter sections to form two half sections.

1 Quarter section
2 Recess
3 Aperture
4 Bungee cord
4*a* First (center) bungee cord
4*b* Second (outer) bungee cord
5 Protrusion
6 First half section
7 Section half section
8 Key
9 Extension (on key)
10 Hole (in corner of quarter section)
11 Receptacle (for receiving key)
12 Leg
12*a* Inner leg
12*b* Outer leg
13 Spring
14*a* Bracket (at base of leg)
14*b* Bracket (in center part of leg)
14 Channel (diagonal)
15 Channel (perimeter)
16 corner piece
17 First protuberance (on inner leg)
18 Second protuberance (on inner leg)
19*a* First internal channel
19*b* Second internal channel
19*c* Third internal channel

19*d* Fourth internal channel
20 Dowel

DETAILED DESCRIPTION OF INVENTION

A. Overview

The present invention is a collapsible, compact, and lightweight product that provides a level surface that can be taken anywhere and used on any surface/terrain. Our unique folding method, keystone locking system, and adjustable legs distinguish this product from any other on the market today. Simply unfold, lock and you have a clean, flat, and sturdy surface to use in numerous applications. The product is lightweight (made from extruded recycled plastics), folds easily (due to tension cords embedded within the table and spring-assist legs), and is sturdy up to 20 pounds (keystone locking system and legs support this weight). The legs have a unique adjustment system that allows each leg to be adjusted from five inches to eight inches in length to allow the table to sit level on any terrain. Each leg contains a simple spring system that allows the legs to 'pop' out of the bottom of the table panel and stay extended for easy set up. To store the table, simply push the leg down, and it locks in place when one is ready to pack the table away. The current version of the table packs down to 6"×6"×1¾" and weighs 14 ounces. When unfolded, the surface area of the tabletop is 12"×12"×⅜" thick. The dimensions disclosed herein reflect a preferred embodiment, but the present invention is not limited to any particular size of the table.

Although there are other portable tables on the market, none is as compact or as lightweight as the present invention, which incorporates our novel folding method and a keystone for locking the table when in use. No other table folds down as small (6×6×1¾ inches), is made from recycled plastics, and weighs less than 14 ounces, all with the strength to hold 20 pounds and adjust to be level on any surface.

Additionally, the adjustable leg design of the present invention is especially unique. Other tables with adjustable legs are much larger and use a common telescoping method, similar to television antennas. The legs on the present invention slide in and out and have four different notches on each of the four sides of the leg that allow for different lengths. Each leg on the table can be adjusted easily and individually based on the attributes of the surface on which it is resting.

B. Detailed Description of the Figures

FIG. 1 is a first perspective view of the present invention shown in a fully collapsed position. As shown in this figure, the present invention comprises four quarter sections 1, each of which is square in shape and has four sides. This figure shows two sides of each of the four quarter sections. Each quarter section has one side (marked as "A" in FIG. 1) that has a recess 2, two apertures 3 configured to receive a bungee cord 4, and a protrusion 5 that is configured to fit within the recess 2 on an adjacent quarter section. In this configuration, each protrusion 5 is situated directly above or below a recess 2 on an adjacent quarter section 1. Each aperture 3 is situated directly above or below an aperture 3 on an adjacent quarter section 1 so that a bungee cord can pass through an aperture 3 on one quarter section and through a similarly situated aperture 3 on the adjacent quarter section, as shown.

On side "A" of each quarter section, the relative positioning of the various components described above is different on every other quarter section. For example. on the first (top) and third (third one down from the top) quarter sections shown in FIG. 1, one aperture 3 is situated at the right end of the side, and a recess 2 is situated a certain distance from the left end of the same side. The second aperture 3 is situated proximate to and to the center (right) of the recess 2. The protrusion 5 is situated a certain distance from and to the center (left) of the aperture 3 on the right end of the side. By contrast, on side "A" of the second (second one down from the top) and fourth (bottom) quarter sections shown in FIG. 1, one aperture 3 is situated at the right end of the side, and a protrusion 5 is situated a certain distance from the left end of the same side. The second aperture 3 is situated proximate to and to the center (right) of the protrusion 5. The recess 2 is situated a certain distance from and to the center (left) of the aperture 3 on the right end of the side. In other words, the positions of the recesses 2 and protrusions 5 are reversed on side "A" of every other quarter section 1.

Referring to side "B" of each quarter section 1, one can see that side "B" is a mirror image of side "A," except that where there was a recess 2 on side "A," there is a protrusion on side "B," and vice versa. That is, on the first (top) and third (third one down from the top) quarter sections shown in FIG. 1, one aperture 3 is situated at the left end of the side, and a protrusion 5 is situated a certain distance from the right end of the same side. The second aperture 3 is situated proximate to and to the center (left) of the protrusion 5. The recess 2 is situated a certain distance from and to the center (right) of the aperture 3 on the left end of the side. By contrast, on side "B" of the second (second one down from the top) and fourth (bottom) quarter sections shown in FIG. 1, one aperture 3 is situated at the left end of the side, and a recess 2 is situated a certain distance from the right end of the same side. The second aperture 3 is situated proximate to and to the center (left) of the recess 2. The protrusion 5 is situated a certain distance from and to the center (right) of the aperture 3 on the left end of the side. Just as on side "A," the positions of the recesses 2 and protrusions 5 are reversed on side "B" of every other quarter section 1.

FIG. 2 is a first perspective view of the present invention shown in a partially collapsed position with two of the four quarter sections situated on top of the two other quarter sections to form two half sections. In this configuration, the top two quarter sections 1 in FIG. 1 have been rotated toward side "B" (with the bungee cords acting as a hinge), and the protrusions on the two rotating quarter sections 1 have been inserted into the recesses 2 on the bottom two quarter sections. At the same time, the protrusions 5 on side "B" of the third and fourth quarter sections have been inserted into the recesses 2 on the first and second (rotating) quarter sections. The bungee cords 4 shown on side "B" in FIG. 1 maintain the connection between the second and third quarter sections while allowing the top two quarter sections to be pulled away from the bottom two quarter sections. To put the table back into the position shown in FIG. 1, the user would pull the two quarter sections on the left-hand side of FIG. 2 away from the two quarter sections on the right-hand side of FIG. 2 just enough to allow the protrusions 5 to clear the recesses 2 and then rotate the two quarter sections on the left-hand side of FIG. 2 back over and on top of the two quarter sections on the right-hand side of FIG. 2. The bungee cords shown on side "A" of the quarter sections in FIG. 1 maintain the connections between the first and second quarter sections and between the third and fourth quarter sections.

Figure 3:
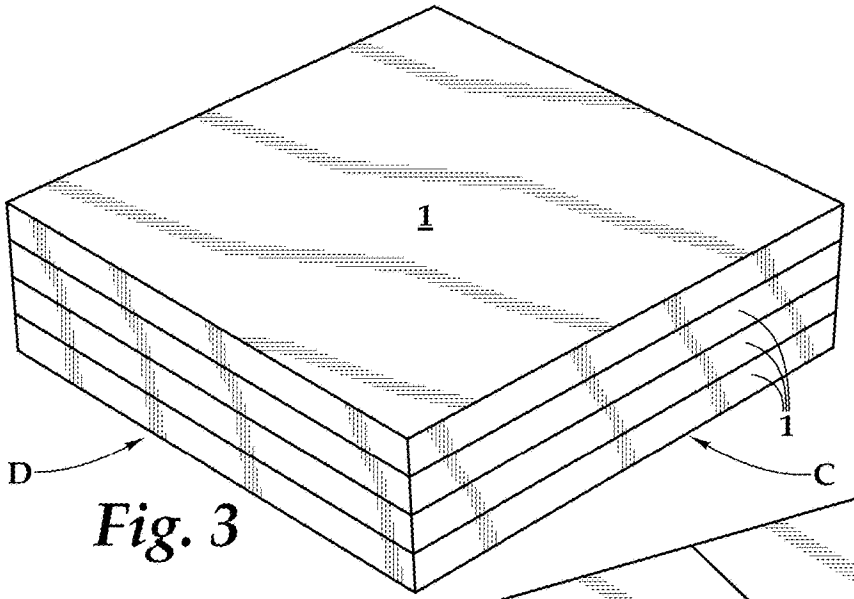
FIG. 3 is a second perspective view of the present invention shown in a fully collapsed position.

FIG. 3 is a second perspective view of the present invention shown in a fully collapsed position. As shown in this figure, each of the four quarter sections 1 comprises a third and fourth side (labelled as "C" and "D") with no recesses, apertures or protrusions. Sides "C" and "D" of each quarter section are simply flat. When the table is fully extended, these sides make up the perimeter of the tabletop (see FIG. 8).

Figure 4:
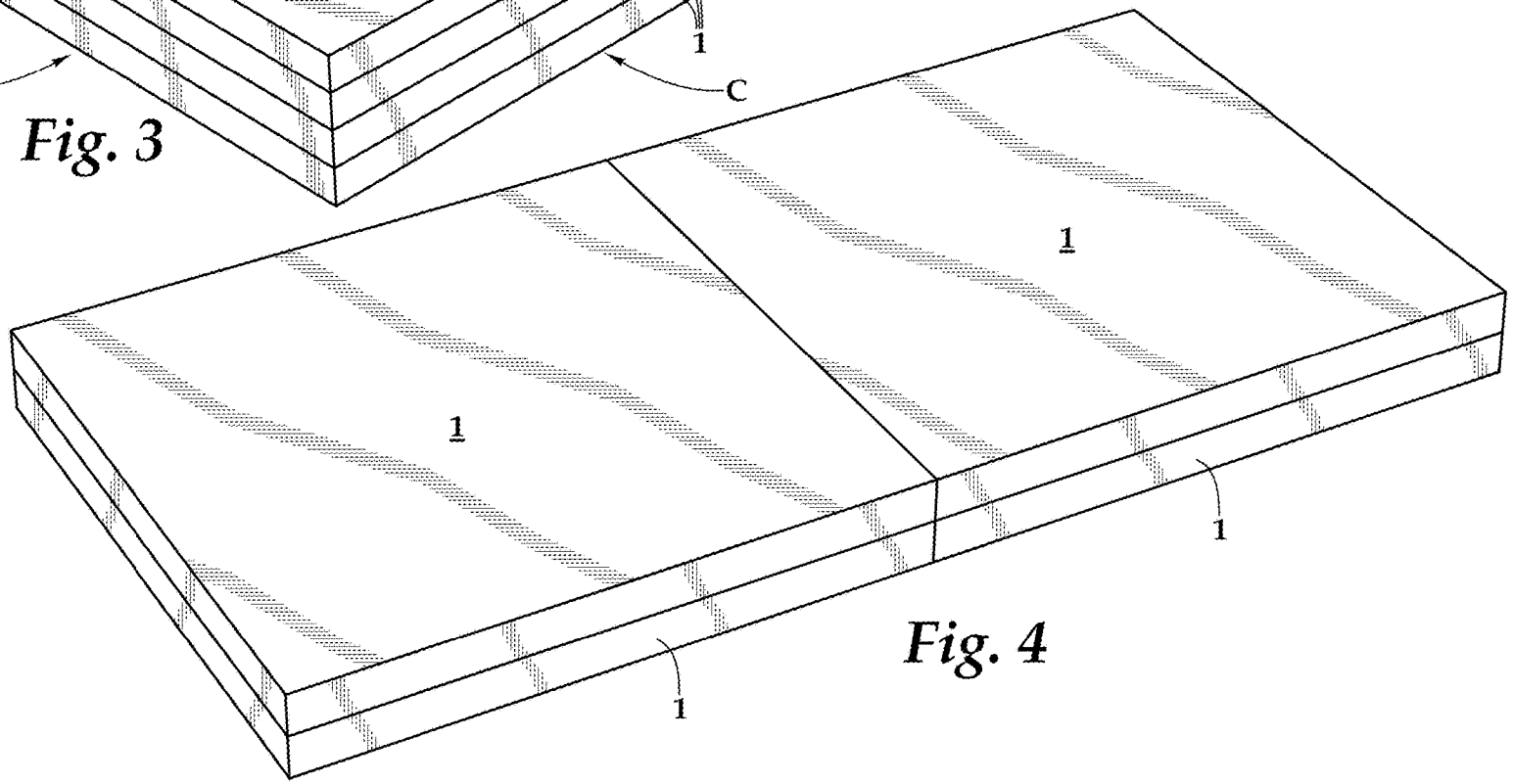
FIG. 4 is a second perspective view of the present invention shown in a partially collapsed position with two of the four quarter sections situated on top of the two other quarter sections to form two half sections.

FIG. 4 is a second perspective view of the present invention shown in a partially collapsed position with two of the four quarter sections situated on top of the two other quarter sections to form two half sections. This figure is the same as FIG. 2 except that it shows side "C" and "D" of each quarter section rather than sides "A" and "B."

Figure 5:
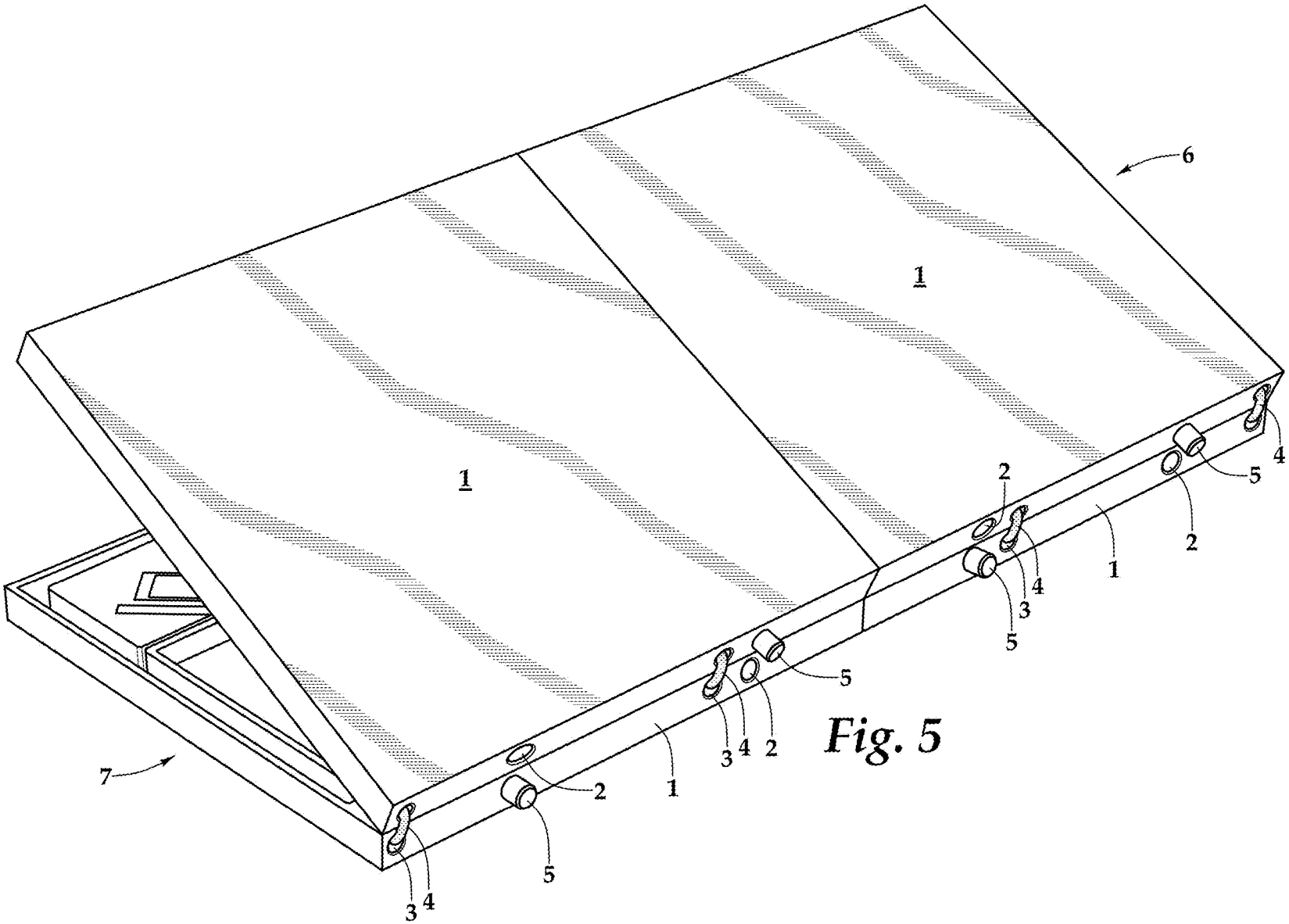
FIG. 5 is a perspective view of the present invention shown partially open with two half sections.

FIG. 5 is a perspective view of the present invention shown partially open with two half sections. This figure is the same as FIG. 2, except that the top (first) half section 6 has been partially raised relative to the bottom (second) half section 7, with the bungee cords 4 between the top and bottom half sections acting as a hinge. Note that the second and third half sections 1 from FIG. 1 form the first half section 6, and the first (top) and fourth (bottom) half sections from FIG. 1 form the second half section 7.

Figure 6:
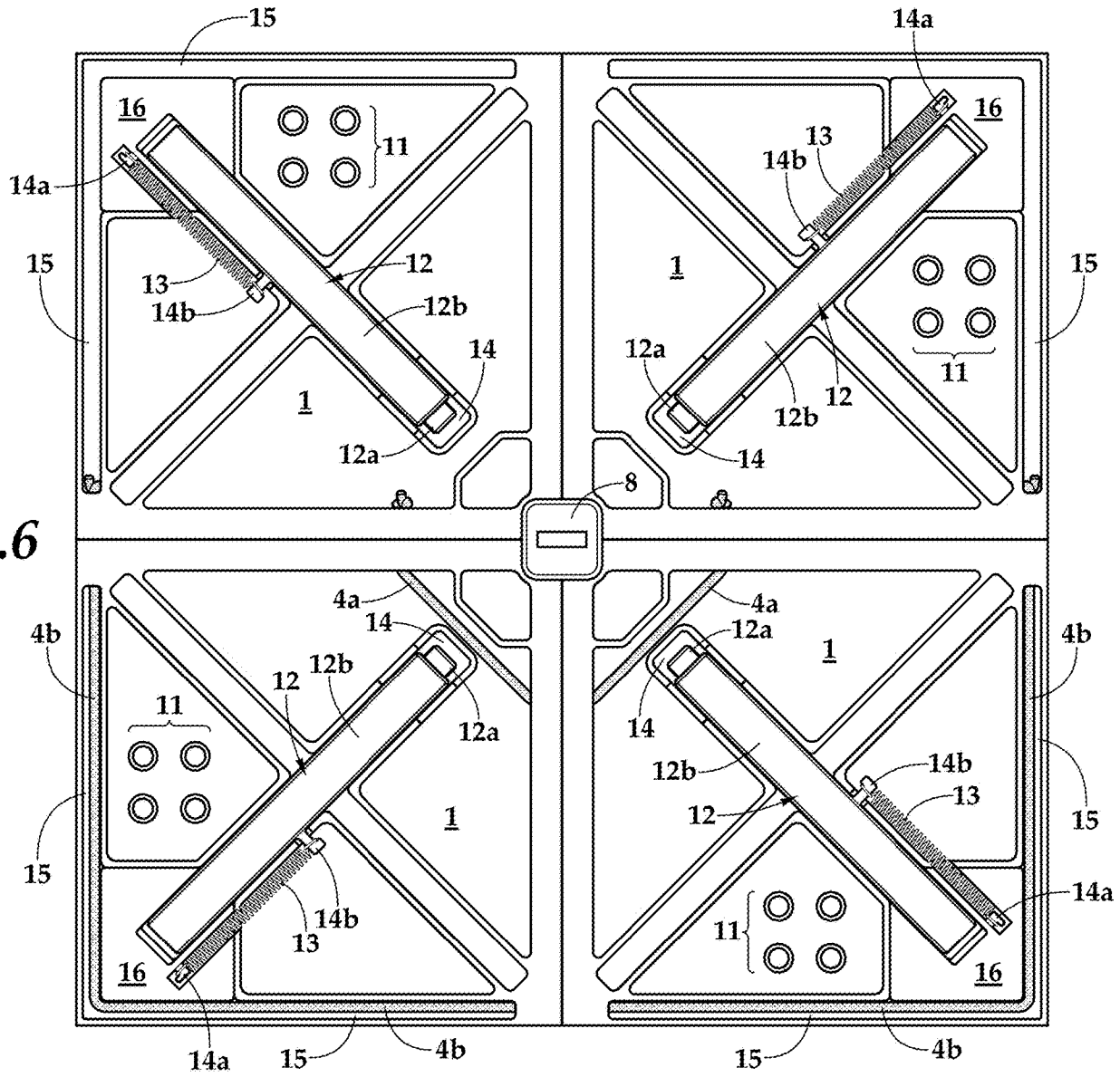
FIG. 6 is a plan view of the underside of the present invention shown with the tabletop fully open and the legs stowed.
Figure 10:
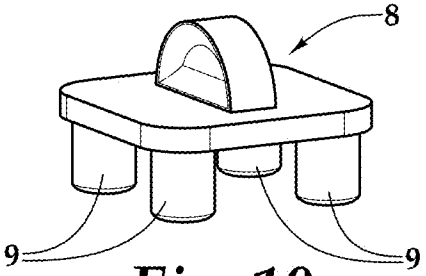
FIG. 10 is a perspective view of the key of the present invention.

FIG. 6 is a plan view of the underside of the present invention shown with the tabletop fully open and the legs stowed. In this figure, the first half section 6 has been fully rotated about the hinge formed by the bungee cords 4 shown in FIG. 5. The invention includes a key 8 with four extensions 9 (see FIG. 10) that are configured to fit within four holes 10 situated at a corner of each of the four quarter sections 1 (one hole per quarter section), in the center of the underside of the tabletop, to lock the tabletop in an open position (see also FIG. 8), This key 8 may be stowed on any one of the quarter sections 1, each of which comprises a receptacle 11 on the underside of the quarter section 1, the receptacle being configured to receive the extensions 9 on the key 8.

As noted above, sides "C" and "D" of the four quarter sections are flat (that is, without recesses, apertures or protrusions). These sides of the quarter sections form the perimeter of the tabletop when it is in a fully extended position, as shown in FIG. 6. In fact, sides "C" and "D" of the quarter sections form a compartment on the underside of the tabletop in which the legs 12 are stowed. Each leg 12 is pivotally connected to an outside corner of one of the quarter sections 1. A spring 13 is oriented parallel to each leg and connected on one end to a bracket 14*a* situated next to the base of the leg and on the other end to a bracket 14*b* situated in a center part of the leg. The springs 13 serve to maintain the legs 12 in place when the legs are either extended or stowed. Each leg 12 fits within a channel 14 that extends diagonally across the underside of the quarter section, from the exterior corner to the center of the tabletop.

Figure 7:
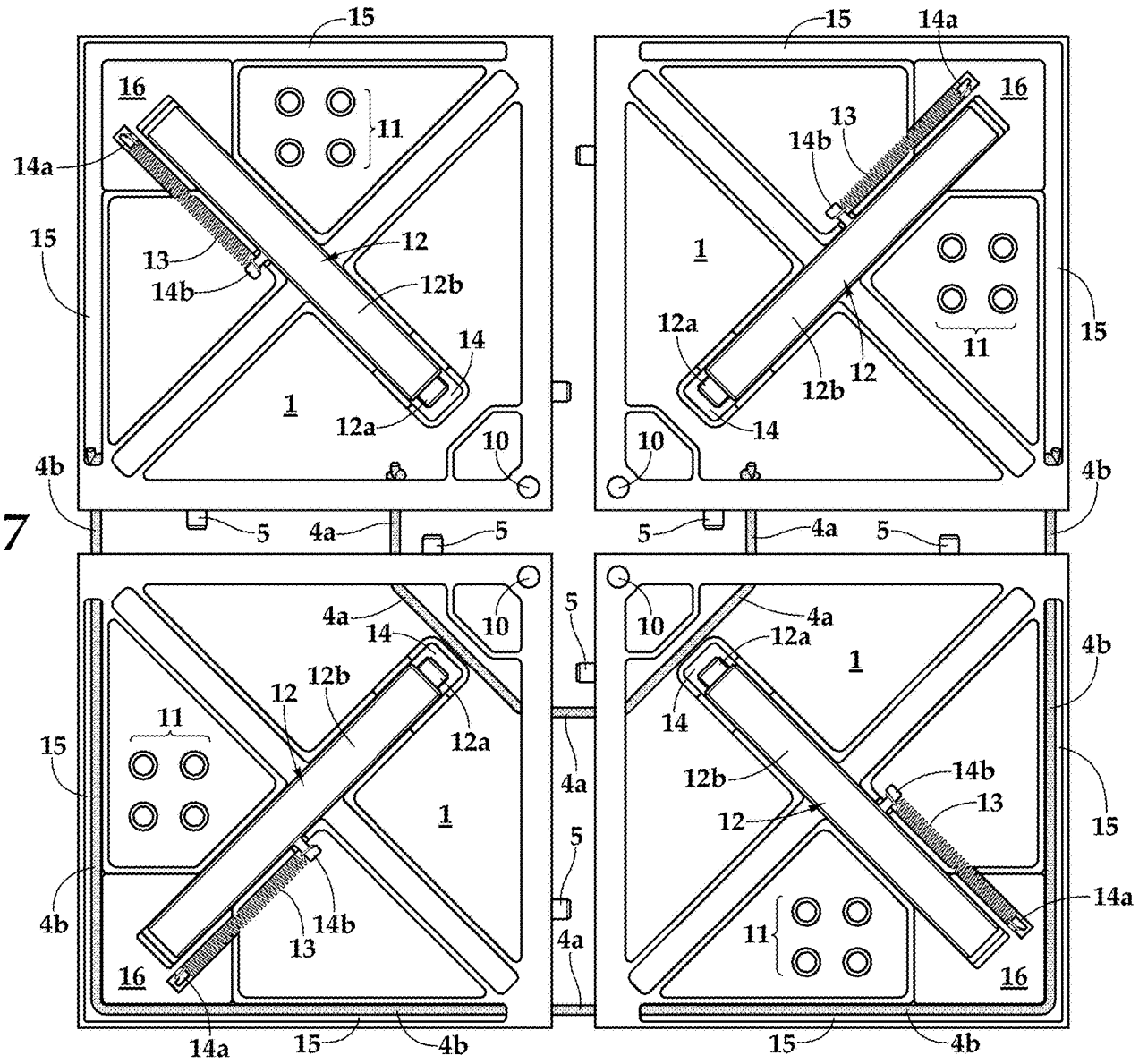
FIG. 7 is the same view as FIG. 6 except that the four quarter sections have been pulled apart to show the bungee cords.

FIG. 7 is the same view as FIG. 6 except that the four quarter sections have been pulled apart to show the bungee cords. The underside of each quarter section 1 comprises a channel 15 that extends along the perimeter of the quarter section, but only on sides "C" and "D" (the flat sides that form the perimeter of the tabletop) of the quarter section. As shown here, the invention comprises two bungee cords. The first bungee cord 4*a* extends through the apertures 3 in all four of the quarter sections at the center of the tabletop; in this manner, the first bungee cord 4*a* secures the center part of the tabletop by holding the quarter sections together at the center of the table. The second bungee cord 4*b* is situated within the channel 15 and extends through the apertures 3 in all four of the quarter sections that are situated on the right or left ends of sides "A" and "B" of the quarter sections; as such, this bungee cord 4*b* serves to maintain the perimeter of the tabletop in the configuration shown in FIG. 6. To remove the tabletop from this configuration, the user would pull the four quarter sections apart, as shown in FIG. 7, rotate one half section over onto the other half section (as shown in FIG. 2), and then flip two of the quarter sections on top of the two other quarter sections, thereby placing the invention back into the configuration shown in FIGS. 1 and 3.

Figure 8:
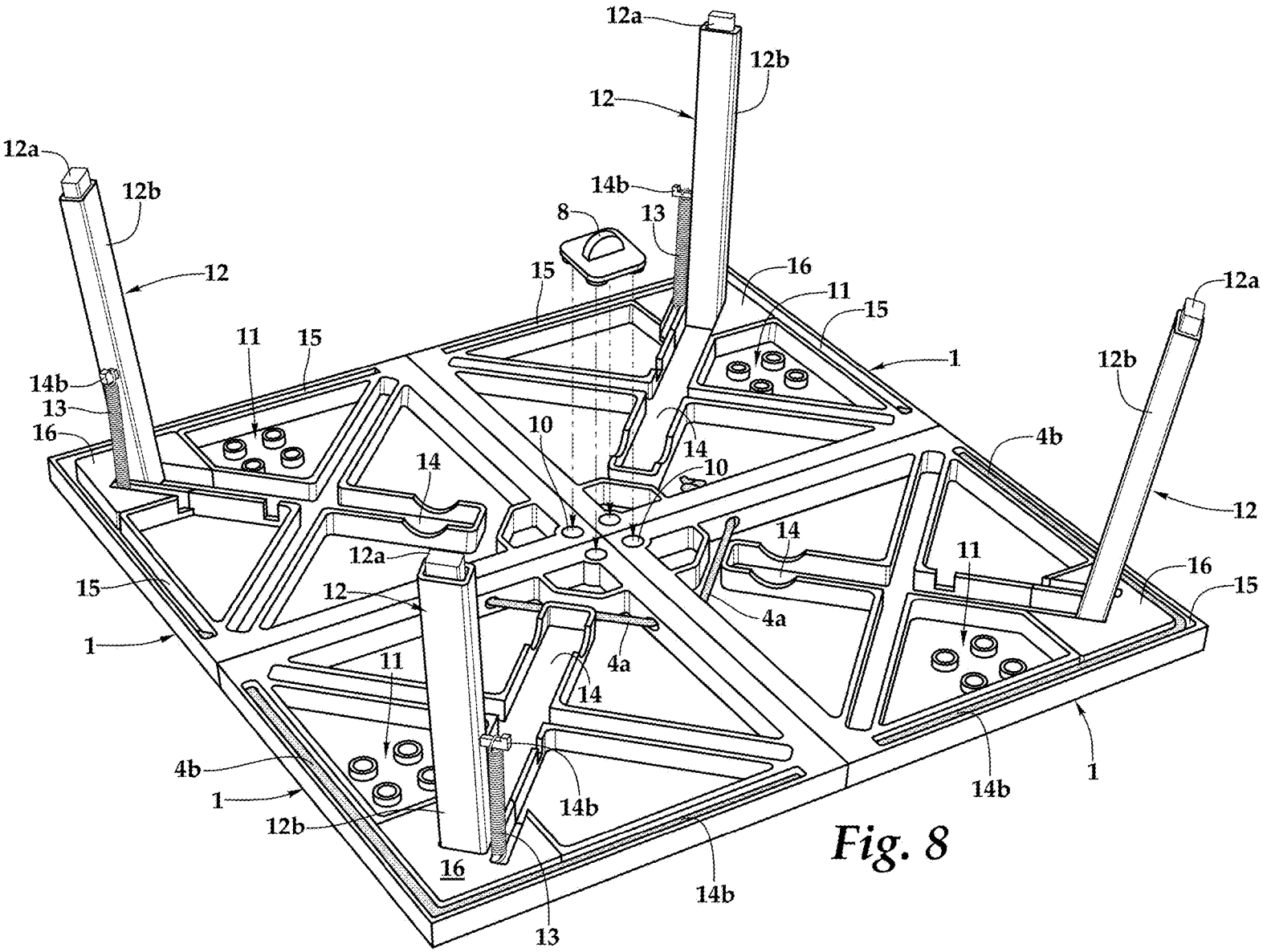
FIG. 8 is a bottom perspective view of the present invention shown with the tabletop fully open and the legs in an extended position.

FIG. 8 is a bottom perspective view of the present invention shown with the tabletop fully open and the legs in an extended position. Each leg 12 comprises an inner leg 12*a* and an outer leg 12*b*. As noted above, the proximal end of each outer leg 12*b* is pivotally connected to an exterior corner of one of the quarter sections 1. The distal end of each outer leg 12*b* is configured to receive an inner leg 12*a*. In a preferred embodiment, the bottom ends of both the outer leg 12*b* and the spring 13 are secured to a separately molded corner piece 16. The inner and outer legs are discussed more fully in connection with subsequent figures.

Figure 9:
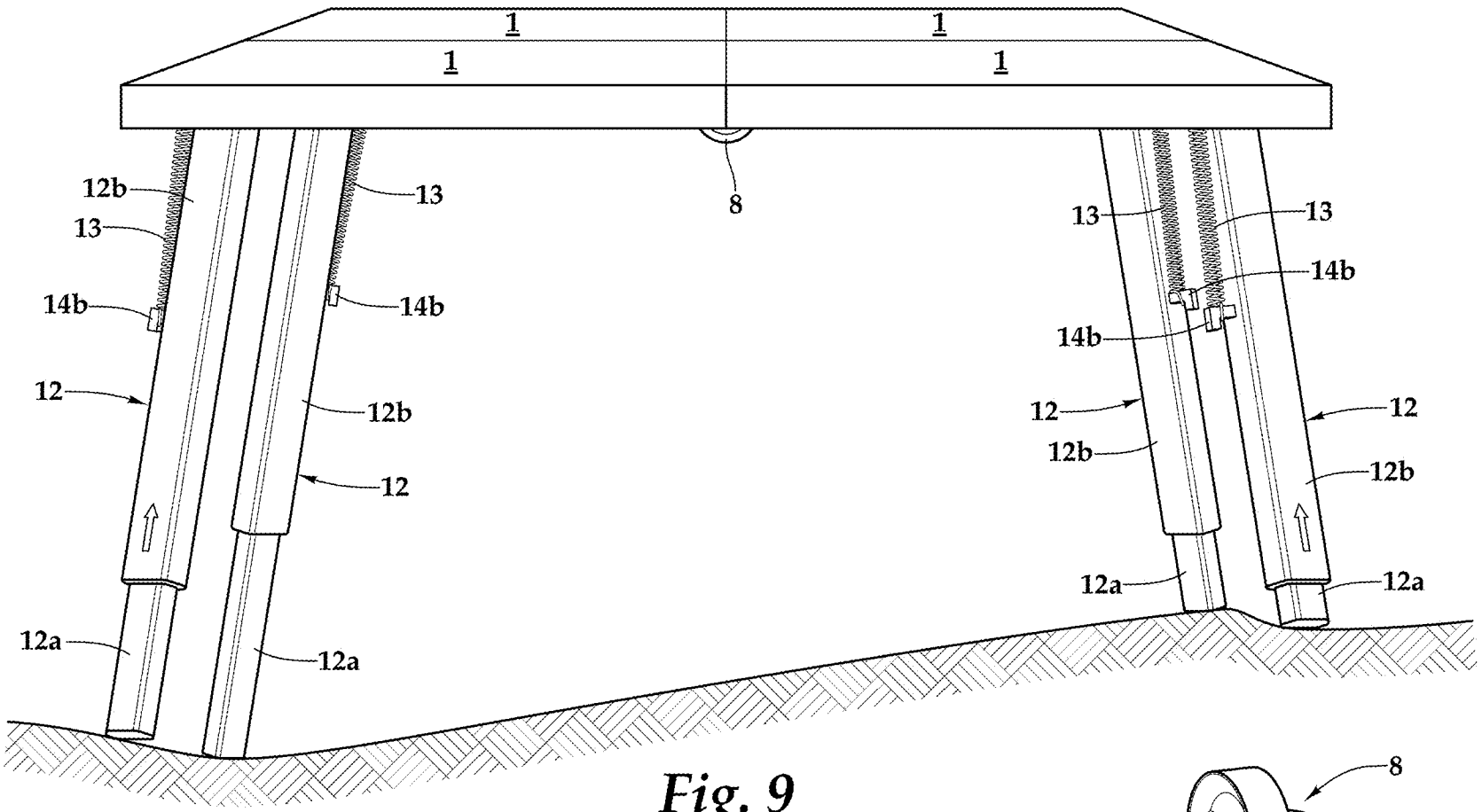
FIG. 9 is a side view of the present invention with the tabletop fully open and the legs extended.

FIG. 9 is a side view of the present invention with the tabletop fully open and the legs extended. The purpose of this figure is to illustrate the usability of the present invention on any ground surface. Because each leg 12 is separately adjustable, the height of each leg can be manipulated to provide a horizontal tabletop even when the underlying surface is uneven. As shown here, the inner legs 12*a* are slidable coupled to the outer legs 12*b*, as explained below.

FIG. 11-15 show the inner leg of the present invention in various views. As shown in these figures and in FIG. 16-20, the inner leg 12*a* is rectangular in cross-section. Thus, the inner leg 12*a* has four sides, two of which (front and back, FIGS. 12 and 15) are wider than the other two sides (right and left sides, FIGS. 13 and 14). In this case, front/rear and right/left are designated arbitrarily for purposes of description; however, in practice, the inner leg may be inserted into the outer leg in one of four different ways; therefore, there is no true front, rear, right or left side of the inner leg 12*a*. The inner leg 12*a* has first and second ends, which are designated as "x" and "y," respectively, in FIG. 10.

Figure 13:
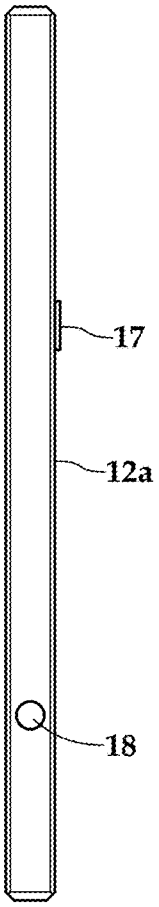
FIG. 13 is a first side view of the inner leg of the present invention.
Figure 12:
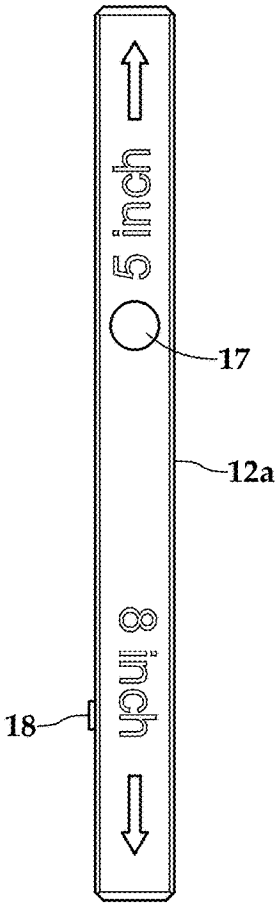
FIG. 12 is a front view of the inner leg of the present invention.
Figure 11:
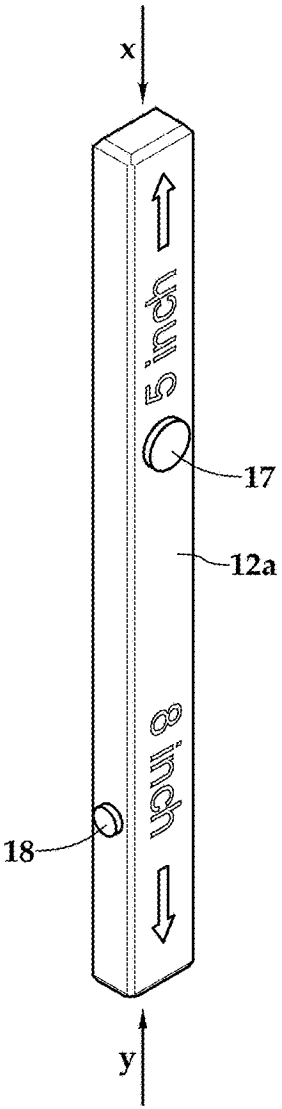
FIG. 11 is a front perspective view of the inner leg of the present invention.
Figure 20:
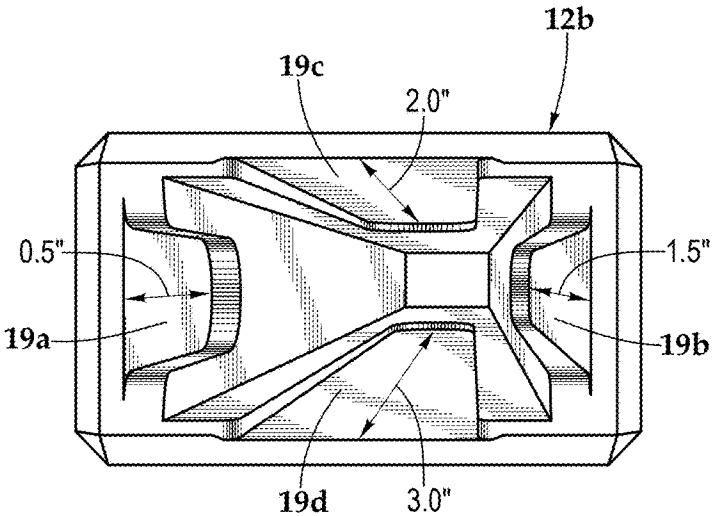
FIG. 20 is a perspective view of the distal end of the outer leg of the present invention.

Referring to FIGS. 11 and 12, the front side of the inner leg comprises a first circular protuberance 17 situated a certain distance from the top end X of the inner leg 12*a*. This protuberance 17 can also be seen in FIG. 13, which is a side view of the inner leg 12*a*. As shown in FIG. 13, the inner leg 12*a* also comprises a second circular protuberance 18 that is situated on a first side of the inner leg. The second protuberance 18 is situated a certain distance from the bottom end Y of the inner leg. In a preferred embodiment, the diameter of the first protuberance 17 is greater than the diameter of the second protuberance 18. The first protuberance is situated closer to the top end of the inner leg than the second protuberance, and the second protuberance is situated closer to the bottom end of the inner leg than the first protuberance. As such, there is a sizeable space between the first and second protuberances. In a preferred embodiment, the height of the first protuberance (that is, the distance by which it extends from the front side of the inner leg) is less than the height of the second protuberance (that is, the distance by which it extends from the first side of the inner leg). This difference in height of the first and second protuberances is a key feature of the present invention, for reasons that will become apparent below.

Figure 15:
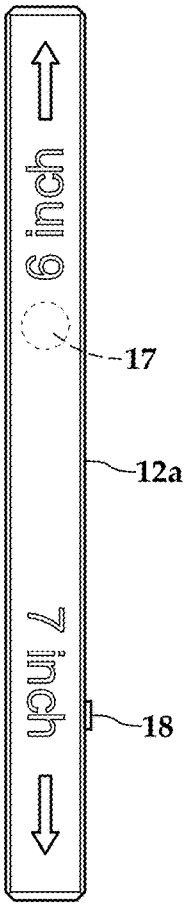
FIG. 15 is a rear view of the inner leg of the present invention.
Figure 14:
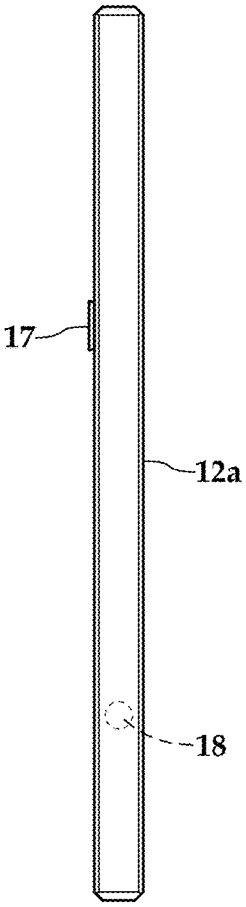
FIG. 14 is a second side view of the inner leg of the present invention.

As shown in FIG. 14, the second side of the inner leg 12*a* has no protuberances and is a flat surface only. As shown in FIG. 15, the back side of the inner leg is also flat and has no protuberances on it. The markings (5 inch, 8 inch, etc.) that are shown in the figures are an optional feature of the invention and are shown here for the purpose of describing the functionality of the protuberances on the inner legs.

Figure 18:
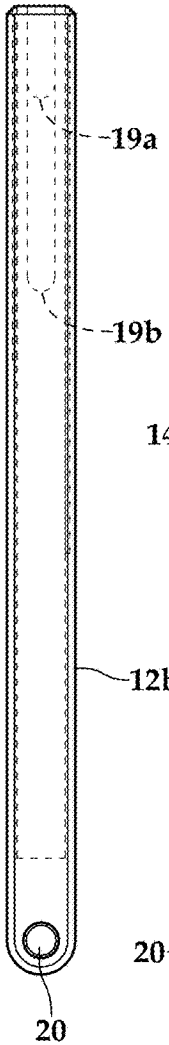
FIG. 18 is a second side view of the outer leg of the present invention.
Figure 17:
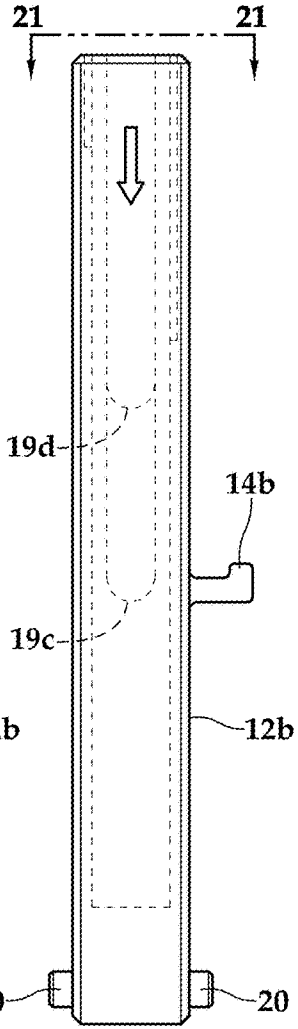
FIG. 17 is a front view of the outer leg of the present invention.
Figure 16:
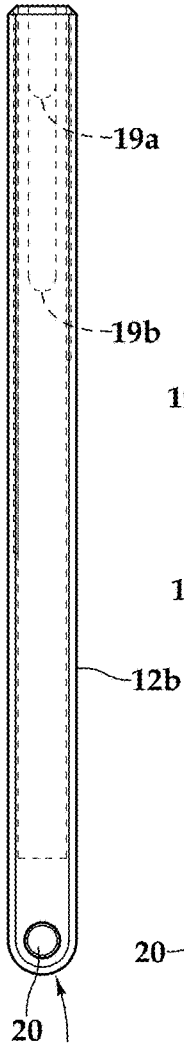
FIG. 16 is a first side view of the outer leg of the present invention.
Figure 22:
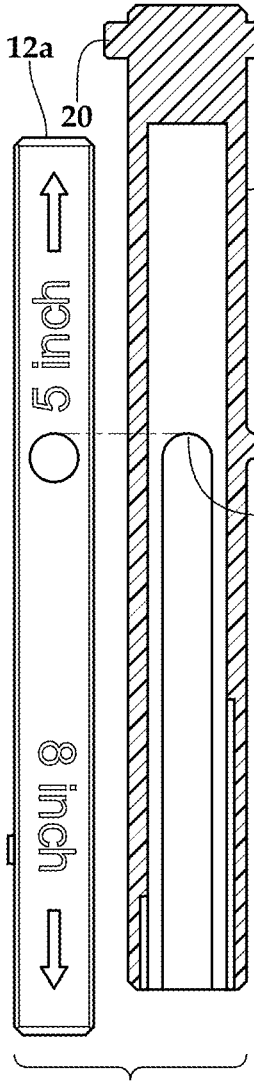
FIG. 22 is a partial cross-section view of the outer leg shown next to the front side of the inner leg.
Figure 23:
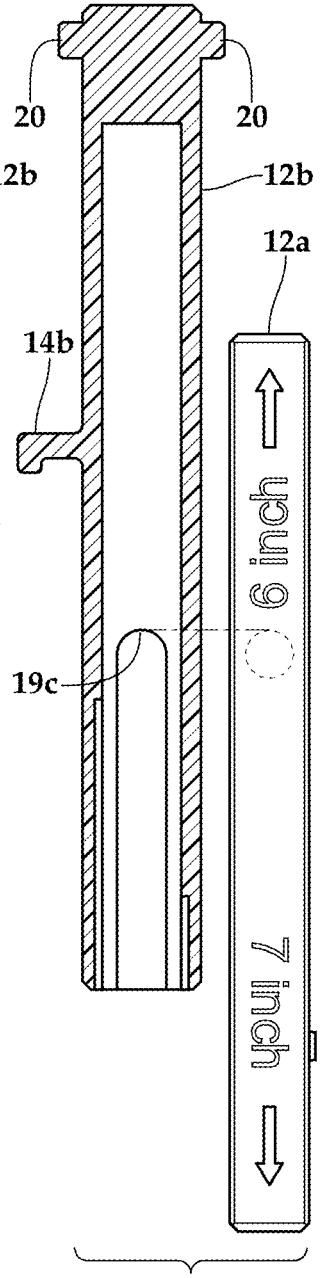
FIG. 23 is a partial cross-section view of the outer leg shown next to the back side of the inner leg.
Figure 24:
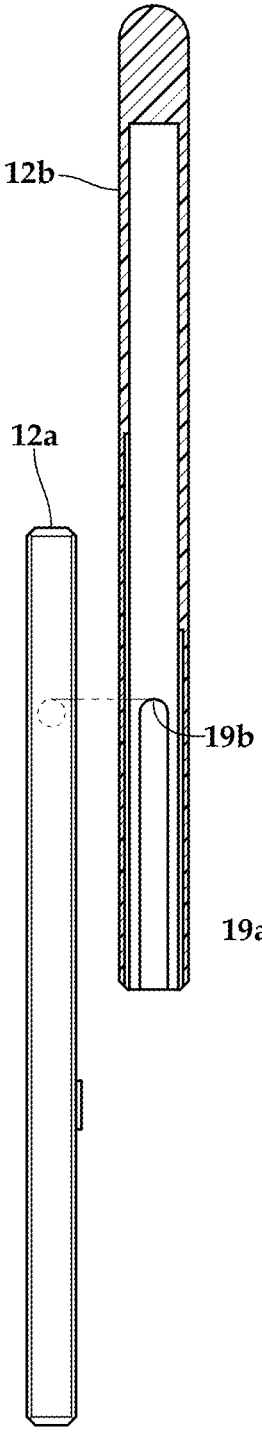
FIG. 24 is a partial cross-section view of the outer leg shown next to a first side of the inner leg.
Figure 25:
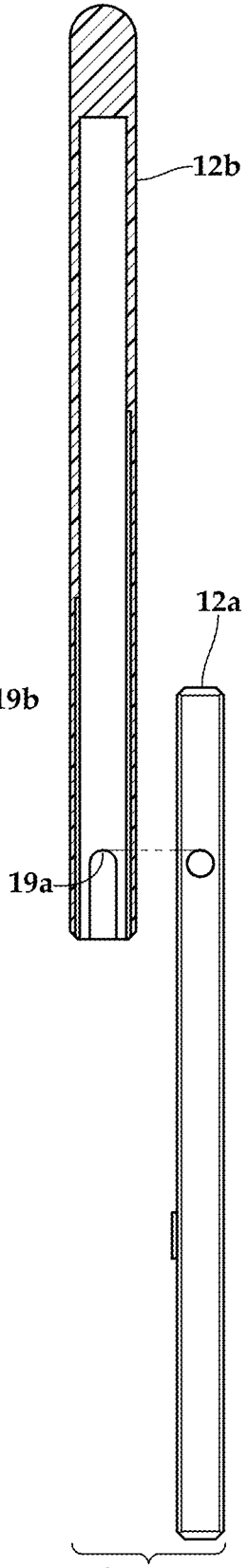
FIG. 25 is a partial cross-section view of the outer leg shown next to a second side of the inner leg.

FIGS. 16-20 are views of the outer leg of the present invention. The purpose of these figures is to show the internal channels that extend longitudinally from the distal end (designated as "z" in FIG. 16) of the outer leg 12*b*. As shown in FIGS. 16 and 18, each side (right and left) of the outer leg 12*b* comprises an internal channel 19*a*, 19*b*. The internal channel 19*a* on the left side of the outer leg is shorter than the internal channel 19*b* on the right side of the outer leg (see FIG. 20). The width of the internal channels 19*a*, 19*b* is configured to receive the second protuberance 18 so that the second protuberance 18 can slide into either of the two internal channels 19*a*, 19*b* (from the distal end of the outer leg) until it reaches the end of the internal channel, which serves as a stop. Similarly, the front and back sides of the outer leg 12*b* also comprise internal channels 19*c*, 19*d* that extend longitudinally from the distal end of the outer leg toward the center of the outer leg. The internal channel 19*c* on the front side of the outer leg is shorter than the internal channel 19*d* on the back side of the outer leg (see FIG. 20). The width of the internal channels 19*c*. 19*d* is configured to receive the first protuberance 17 so that the first protuberance 17 can slide into either of the two internal channels 19*e*, 19*d* (from the distal end of the outer leg) until it reaches the end of the internal channel, which serves as a stop. Note that the depth of the two internal channels 19*c*, 19*d* that receive the first protuberance 17 is less than the depth of the two internal channels 19*a*, 19*b* that receive the second protuberance 18. This is because the height of the first protuberance is less than the height of the second protuberance, as noted above. By inserting the inner leg 12*a* into the outer leg 12*b* in alternate directions, the overall height of the leg 12 (comprising both the inner and outer legs 12*a*, 12*b*) can be adjusted to a desired height, and each leg 12 is individually adjustable.

Figure 21:
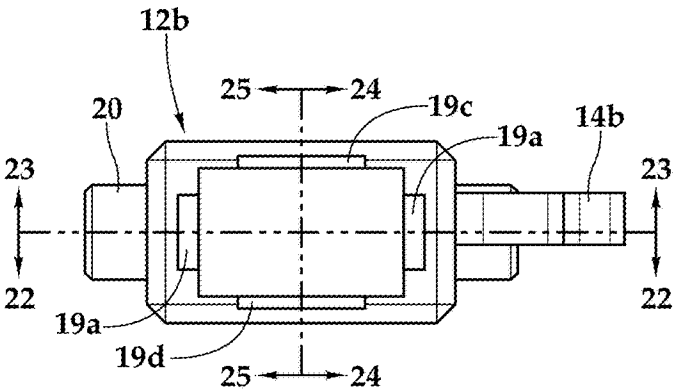
FIG. 21 is an end (bottom) view of the outer leg of the present invention.
Figure 19:
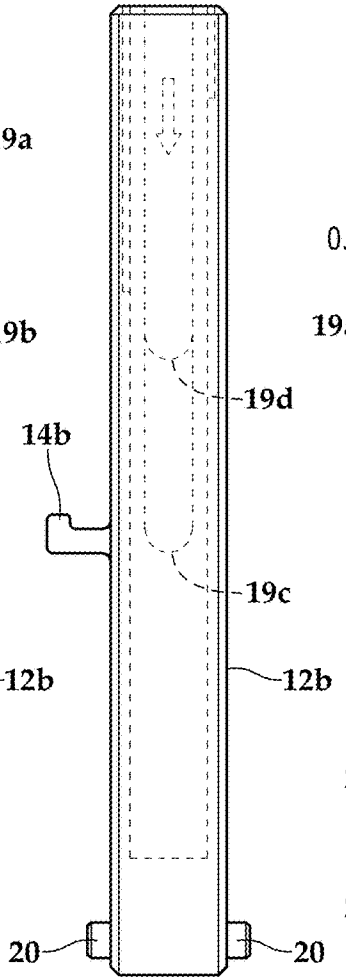
FIG. 19 is a rear view of the outer leg of the present invention.

FIGS. 22-25 illustrate the principle described above, namely, that the inner leg may be inserted into the outer leg in four different configurations: top end first with one side to the right, top end first with the opposite side to the right, bottom end first with one side to the right, and bottom end first with the opposite side to the right. In other words, the inner leg may be flipped top-to-bottom and right-to-left, depending on which height adjustment is desired. The varying lengths of the four inner channels 19*a*, 19*b*, 19*c* and 19*d* and the position in which the inner leg 12*a* is inserted into the outer leg 12*b* will determine the overall height of the leg 12. The purpose of FIG. 21 is to show where the cross-sections are taken for FIGS. 22-25. The proximal end (base) of each leg 12 pivots about a dowel 20, which is fixedly attached to (or part of) the outer leg and rotatably coupled to the corner piece 16 (see FIGS. 17 and 19).

C. Operation and Use of the Invention

As described above, the present invention is designed to be used in outdoor camping environments when sitting in a CRAZY CREEK PRODUCTS® folding chair; however, there are multiple alternative scenarios in which a small table could be useful. The present invention can be used anywhere anyone wishes to have a flat, clean and elevated surface that can support multiple items, including: food preparation, food serving, level drink holder, cutting board, level lantern, and stove platform. The present invention does not have to be used on the ground; it can be used on a picnic table, truck tailgate, toolbox, top of a cooler, in the tent, on a boat, and anywhere a flat, level and clean surface is needed. The present invention can be set up in under 20 seconds.

To set up the present invention, simply hold one corner of one panel of the table and let gravity unfold the whole table. Elastic stretch cord is embedded within the tabletop, causing the table to pop into its proper position, which is then held stable by ¼" prongs that fit into perfectly sized holes on the underside of the tabletop panels. To lock the tabletop in place so that the table is stable and can handle weight (up to 20 lbs.), remove the keystone (four-pronged attachment) and place it in the designated center hole position to lock the table in place. The legs fold into the table top itself. Simply unfold them outwards from their hinged corner position, and the spring assist makes them stay extended in a set up position, making the tabletop sit five inches (in a preferred embodiment) off the ground. Each leg has a removable end/section that fits within the main leg section. To adjust the height, pull out the inner section of the leg and choose the height you want in one-inch increments and insert it back into the leg. There are custom notches within the leg that stop the extendable leg position based on the height chosen. This allows a user to get the table level on most any terrain—rocky ground, inclines or any unlevel surface on which the table is set up.

To fold up and pack the table away, this is also done in less than 20 seconds. First, make sure the legs are set to the original five-inch height, and fold them into the tabletop itself. Next, remove the keystone and place it in the designated location underneath the tabletop to secure and store the keystone when packed up. The last step is to pull the table apart and fold it closed. First, pull from each vertical side of the table to fold the table in half. Next, pull from the top and bottom, and fold the two panels on top of each other. The elastic cording allows the chair to only fold one way for ease of use. Finally, store the table anywhere it fits within your pack, picnic basket or vehicle.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. A collapsible table comprising:

(a) four quarter sections, each of which has a top surface that is flat and square, an underside that is the same size as the top surface, a first side, a second side, a third side, and a fourth side:

wherein the first side of each quarter section comprises a protrusion, a recess that is configured to receive the protrusion on an adjacent quarter section, and two apertures that are configured to allow a bungee cord to pass through them;

wherein the second side of each quarter section comprises a protrusion, a recess that is configured to receive the protrusion on an adjacent quarter section, and two apertures that are configured to allow a bungee cord to pass through them;

wherein the third side of each quarter section is flat; and wherein the fourth side of each quarter section is flat;

(b) a key with four extensions;

wherein the underside of each quarter section comprises a hole that is situated in a corner of the underside and configured to receive one of the four extensions on the key:

(c) four outer legs; and (d) four inner legs;

wherein each of the four outer legs is pivotally connected to a corner of one of the four quarter sections at a pivot point; and wherein each of the four inner legs is slidably coupled to one of the four outer legs so that the inner leg slides within the outer leg; and (e) a first bungee cord;

wherein the first bungee cord is configured to pass though one aperture in each of a first two of the quarter sections and two apertures in each of a second two of the quarter sections, wherein the apertures through which the first bungee cord passes are situated in a center part of the underside of the table when the table is in a fully extended position.

2. The collapsible table of claim 1, further comprising:

a second bungee cord;

wherein the underside of each quarter section comprises an outside channel that extends along an outside edge of the third side and the fourth sides of the quarter section;

wherein the second bungee cord is situated within the outside channel of and configured to pass through two apertures in a first two of the four quarter sections, the two apertures being situated proximate to an outer edge of the underside of the quarter section; and wherein the second bungee cord is configured to pass through one aperture in a second two of the four quarter sections, the one aperture being situated proximate to the outer edge of the underside of the quarter section.

3. The collapsible table of claim 1, wherein each of the quarter sections comprises a spring that is attached on one end to the corner of the quarter section proximate to the pivot point and on the other end to a center part of the outer leg.

4. The collapsible table of claim 1, wherein each of the outer legs is configured to fit within a diagonal channel that extends diagonally across the underside of the quarter section to which the outer leg is pivotally attached.

5. The collapsible table of claim 1, wherein each outer leg is rectangular in cross-section;

wherein each of the outer legs comprises a first inner wall, a second inner wall, a third inner wall, and a fourth inner wall;

wherein each of the first inner wall, the second inner wall, the third inner wall, and the fourth inner wall comprises an internal channel that extends longitudinally from a distal end of the outer leg for a certain distance;

wherein the distance by which the internal channel in the first inner wall extends from the distal end of the outer leg is less than the distance by which the internal channel in the second inner wall extends from the distal end of the outer log, the distance by which the internal channel in the second inner wall extends from the distal end of the outer leg is less than the distance by which the internal channel in the third inner wall extends from the distal end of the outer leg, and the distance by which the internal channel in the third inner wall extends from the distal end of the outer leg is less than the distance by which the internal channel in the fourth inner wall extends from the distal end of the outer leg, thereby creating four different internal channels of four different lengths in the inner walls of the outer leg; and wherein the internal channels on a first two opposing inner walls of the outer leg each has a first depth, and the internal channels on a second two opposing inner walls of the outer leg each has a second depth, the first depth being less than the second depth.

6. The collapsible table of claim 5, wherein each inner leg is rectangular in cross-section;

wherein each of the inner legs comprises a first protuberance on a first side of the inner leg and a second protuberance on a second side of the inner leg, the first and second sides of the inner leg being adjacent and not opposing;

wherein each of the first protuberance and the second protuberance has a height, the height of the first protuberance being less than the height of the second protuberance; and wherein the first protuberance is configured to fit within the internal channels on the first two opposing inner walls of the outer leg, and the second protuberance is configured to fit within the internal channels on the second two opposing inner walls of the outer leg.

* * * * *